US005785545A

United States Patent [19]

Holt

[11] Patent Number: 5,785,545

[45] Date of Patent: Jul. 28, 1998

[54] CONNECTOR FOR JOINING TWO ELECTRICAL CONNECTION ASSEMBLIES

[75] Inventor: Timothy Lee Holt, La Quinta, Calif.

[73] Assignee: The Deutsch Company, Santa Monica, Calif.

[21] Appl. No.: 677,460

[22] Filed: Jul. 2, 1996

[51] Int. Cl.[6] ..... H01R 13/627

[52] U.S. Cl. ..... 439/352; 439/321

[58] Field of Search ..... 439/320, 321, 439/350, 352

[56] References Cited

U.S. PATENT DOCUMENTS

| | | | |
|---|---|---|---|
| 2,566,993 | 9/1951 | Parsons . | |
| 3,156,512 | 11/1964 | Peterson et al. . | |
| 3,176,259 | 3/1965 | MacNamara . | |
| 3,680,033 | 7/1972 | Kawai . | |
| 3,888,559 | 6/1975 | Geib . | |
| 3,960,429 | 6/1976 | Moulin . | |
| 4,493,520 | 1/1985 | Davies . | |
| 5,192,219 | 3/1993 | Fowler et al. . | |
| 5,195,905 | 3/1993 | Pesci . | |
| 5,595,499 | 1/1997 | Zander et al. | 439/352 |
| 5,653,606 | 8/1997 | Chrysostomou | 439/352 |

*Primary Examiner*—Khiem Nguyen
*Attorney, Agent, or Firm*—Pretty, Schroeder & Poplawski

[57] ABSTRACT

A connector for joining two electrical connection assemblies including first and second assembly housings, each having a generally tubular wall open at one end. The first assembly housing has a cam. A collar is slidably attached to the exterior of the tubular wall of the second assembly housing. A moveable tab on one of the second assembly housing and the collar is in axial alignment with the cam of the first assembly housing. A stop ridge on the other of the second assembly housing and the collar is aligned with the tab so that the tab contacts the stop ridge at a predetermined point and restricts axial movement of the collar relative to the second assembly housing. Upon assembly of the first assembly housing and the second assembly housing, at a predetermined point of axial motion of the one with respect to the other, the cam of the first assembly housing pushes the moveable tab, disengaging the tab from the stop ridge, so that the collar is no longer so restricted, by contact of the tab and the stop ridge, from axial movement relative to the second assembly housing and the collar is thus permitted to move axially toward the first housing.

20 Claims, 7 Drawing Sheets

CONNECTOR FOR JOINING TWO ELECTRICAL CONNECTION ASSEMBLIES

BACKGROUND OF THE INVENTION

This invention relates generally to connectors for joining corresponding pairs of electrical plug and receptacle components, and in particular, to a connector having a pair of corresponding housings and a collar that locks the housings in coupled engagement.

Connectors in which electrical plug and receptacle elements are held in corresponding housings have been used for numerous applications to provide additional insulation to the surrounding environment, as well as to safeguard the person making the connection. Such paired housing connectors have used a variety of fastening methods to hold the two housings together. One type of fastening structure employs an indent on one housing and a protrusion on the other housing, which interlock when the two housings are coupled to each other. Some connectors have further included a moveable collar on one of the housings, to increase the holding effect of interlocking protrusion and indent when the housings are coupled.

One such electrical connector is described in the U.S. Pat. No. 3,176,259. That connector includes a tubular plug assembly, a tubular receptacle assembly, and a tubular actuator sleeve. The receptacle assembly telescopically fits within the plug assembly. The receptacle assembly includes a collet having spring fingers whose free ends are formed into heads protruding radially inwardly. The plug assembly has a radially outwardly opening circumferential groove. The heads of the spring fingers are disposed to be received in the groove, but initially, the heads are biased radially outwardly from the groove.

The tubular actuator sleeve is slidably arranged on the receptacle assembly and slidably encompasses the collet. The actuator sleeve has an inner collet finger engaging portion, responsive to axial movement of the sleeve in one direction, to move the free front ends of the fingers against the yielding bias thereof, into the groove. The receptacle assembly may be equipped with a pair of grooves, the distance between which corresponds to the distance necessary for the actuator sleeve to travel in moving the spring fingers from disengagement to engagement with the groove and vice versa. The actuator sleeve has a split ring with serves to yieldingly lock the sleeve into engagement with the receptacle in two distinct positions, one in which the spring fingers are disconnected from the plug groove, and the other in which the heads are interlocked with the groove of the plug.

One disadvantage of the connector disclosed in U.S. Pat. No. 3,176,259 is that while the yielding lock of the actuator sleeve does provide resistance to movement of the actuator sleeve with respect to the collet, it does not positively prevent such movement. Moreover, the yielding lock mechanism is entirely independent of the plug, and thus the sleeve can be moved into either position, either before or after the receptacle assembly and plug assembly are engaged with each other, causing confusion as to the proper position of the sleeve both prior to and following telescopic joining of the two assemblies. Thus, the user of such a connector may attempt to join the two plug and receptacle assemblies when the actuator sleeve is in the forward position, which may cause breakage to the connector. Moreover, this structure may allow the user to inadvertently fail to lock the connector at all.

Another known connector is that disclosed in U.S. Pat. No. 2,566,993. That connector has two tubes, one of which has a groove, and the other of which has slots forming spring-like elements, and a resilient slidable collar. The spring-like elements each have a grip. When fully coupled, the grips of the one tube engage the groove of the other tube. The resilient slidable collar, which has a molded lip, is then slid over the grips, whereupon the molded lip snaps into a groove formed by the outside of the grips. The collar also has a rigid metal ring set within its rear to counteract the resilient hold of the collar on spring-like elements within the groove in the other tube. A disadvantage of this connector is that it requires a two-step coupling procedure; first telescopically joining the two tubes, and second moving the resilient collar into a locking position, over the grips of the spring-like elements. Further there is again the disadvantage that the collar can be moved into the locking position without coupling of the tubes. This would permit attempted coupling even when the grips are being compressed by the collar. Another disadvantage arises from the resiliency of the collar. While the collar does have a rigid metal ring set within it, this rigid ring does not directly hold the grips. Rather, the grips are held directly only by the resilient collar, and thus, a sufficient force may cause the grips to be pulled outward, overcoming the resilient hold of the collar. Moreover, because the collar is composed mostly of resilient material, forced coupling with the collar in the locking position may be inadvertently attempted, and carried out to a point of either breakage of the device, or incomplete or unlocked coupling.

Another example of a known connector is that disclosed in U.S. Pat. No. 3,680,033. That connector includes a tubular body, into which a male connector is embedded, a tubular body into which a female connector is embedded, and an outer tube surrounding the latter, biased by a spring toward the connecting end of that tubular body. The tubular body with the male connector is fitted with a connecting ring made of resilient material, which has leg portions which themselves have inwardly projecting portions. The tubular body with the female connector has outer recesses on its outer periphery, which are initially covered by the outer tube. When the two tubular bodies are connected to each other, the leg portions of the connecting ring push the outer tube back, against the spring force, to expose the outer recesses of the tubular body with the female connector. As the inwardly projecting portions of the connecting ring come into registration with the outer recesses, the resiliency of the ring causes the projecting portions to fall into the recesses. This removes the contact of the connecting ring against the inner inclined portion of the outer tube, and the force of the spring moves the outer tube back to its original, forward biased position. Displacement of the inwardly projecting portions from the outer recesses of the other tubular body is inhibited by the inner wall of the outer tube. To uncouple the connector, the outer tube must be moved against the spring, to allow the connecting ring to be released from the outer recesses of the tubular body with the female connector.

A major disadvantage of this connector is that the outer tube is in the same position when the connector is coupled, and locked, as it is when the connector is uncoupled. Thus, the position of the outer tube cannot serve as an indicator of the proper positioning of the locking mechanism prior to coupling of the connector. Another disadvantage of this connector is that it requires the direct force of the connecting ring projecting portions against the outer tube and the spring biasing the outer tube to expose the outer recesses and to allow the inwardly projecting portions of the connecting ring to fall into the recesses. While this may be workable for small, light weight and light duty connectors, larger, heavy duty connectors may make such force between the connector ring and the spring loaded outer tube difficult, or cause breakage or failure of the connector.

In view of the above, it should be appreciated that a need exists for an electrical connector in which the locking collar is always in the unlocked position prior to coupling of the connector elements, and which can only be moved into its locking position when the connector elements are properly coupled. Further, a need exists for such a connector which provides a clear indication to a user that the collar is in its unlocked position prior to coupling, and in which coupling and locking, and unlocking and uncoupling, can be accomplished with a single push or pull motion. Moreover, a need exists for an electrical connector with such a locking mechanism which can be made and operated regardless of the size of the connector components.

SUMMARY OF THE INVENTION

The present invention is embodied in a connector for joining a pair of corresponding electrical- plug and receptacle assemblies in which the assemblies are held in corresponding housings, which are themselves easily but securely coupled, and easily uncoupled, in a simple "push and pull" operation. A locking feature prevents inadvertent uncoupling once the housings are coupled, while allowing for a simple, one-hand pull action, to uncouple the housings. When the housings are not coupled, the locking feature cannot be inadvertently activated. Rather, the locking feature can only be actuated in the coupling process, and thus serves as a positive indication to the person coupling the connector that the device is in its proper initial position prior to coupling, as well as a positive indication that the coupling has been properly carried out, and that the housings have been locked, afterwards.

The connector of the present invention includes a first housing and a second housing, in which respective electrical connection assemblies, such as corresponding pin and socket assemblies, are held. Each of the housings has a generally tubular wall, the tubular walls being preferably sized such that during assembly of the housings, the tubular wall of one of the two housings fits, in general axial alignment, within the tubular wall of the other housing. A collar, slidably attached to one of the housings, is slid to a locking position when the housings are coupled, to secure the coupling of the two housings to each other. In particular, the housing with the collar also may have fingers, with heads sized to interlockingly fit into a groove on the opposite housing when coupling of the two housings is achieved. Thus, once coupled, the heads of the fingers of the one housing are retained within the groove of the other housing, and in this manner, the two coupled housings are held in coupled engagement. During this process, the collar is slid over the heads to prevent accidental dislodgment of the heads from-the groove of the other housing.

A feature of the present invention is a tab on the collar, a stop wall on the housing upon which the collar is slidable mounted, and a cam on the other housing. The tab initially contacts the stop wall on the housing to which it is slidably attached, and this contact blocks forward movement of the collar, with respect to that housing. The tab and stop wall are so positioned that the stop wall prevents the collar from being moved forward to a position in which it contacts the heads of the fingers of that housing. During the coupling operation, the cam on the other housing pushes the tab from its initial position, removing its contact with the stop wall. With the tab/stop wall contact broken, the collar is free to be moved forward on its housing, to a position in which it contacts the finger heads as the heads become engaged with the groove of the other housing. A major advantage of this connector is that it ensures that the collar is in its initial position, not contacting or compressing the heads of the fingers, prior to coupling of the housings. This prevents possible damage to the connector which might occur if coupling were to be attempted when the collar is contacting or compressing the heads. Moreover, it takes the guesswork out of coupling the housings, as the person performing such an operation does not need to check the original position of the collar, and, because the collar always begins in the same initial position, there is no confusion as to which way it should be moved to effect locking upon coupling.

Another feature of the present invention is that the extended fingers can be made integral with the housing, and a material such as molded plastic can be used. Because the tab prevents the collar from being moved over the heads of the fingers until coupling is performed, the possibility of breakage of the heads or fingers, by attempted coupling with the collar in the "lock" position, is eliminated.

Another feature of the present invention is that a number of tabs can be formed around the circumference of the one housing with a corresponding number of cams formed around the circumference of the other housing. An advantage of this feature is that the contact forces on any particular tab or cam can be kept to a minimum, by increasing the corresponding total number of each. By so spreading such forces over a large number of corresponding tab and cam structures, the connector housings may be made very large.

Another feature of the present invention is a pair of grooves on the housing with the collar, and a sill on the collar. The sill of the collar can be selectively engaged with one or the other of the grooves, depending on whether the collar is in its initial position or its locking position. Action of the sill as it is selectively engaged between one or the other of the grooves provides an audible and tactile indication of such selective engagement, and thus an audible and tactile indication of movement of the collar between unlocked or locking positions. The advantage of this feature is that a person assembling the two housings into coupled engagement can be assured that proper coupling has been achieved even in situations where visual inspection of the connector may not be easily or accurately done.

Another feature of the present invention is that the structure allows the housings and collar to be made entirely of plastic, and each of these components can be molded with no further machining or incorporation of other materials or components.

Another feature of the present invention is a visual indicator, arranged on the housing with the collar, the indicator being visible only when the collar is in its locking position. The advantage of this feature is that in cases where visual inspection can be carried out effectively, an inspector can instantly tell whether a connector has been fully coupled and locked by seeing if the indicator is showing. Moreover, a person coupling the connector can visually verify that the collar is in its proper, initial position prior to attempting assembly, by checking that the visual indicator is not showing.

Other features and advantages of the invention will become apparent from the following detailed description, taken in conjunction with the accompanying drawings, which illustrate, by way of example, the principles of the invention.

DESCRIPTION OF THE PREFERRED EMBODIMENT

Figure 1:
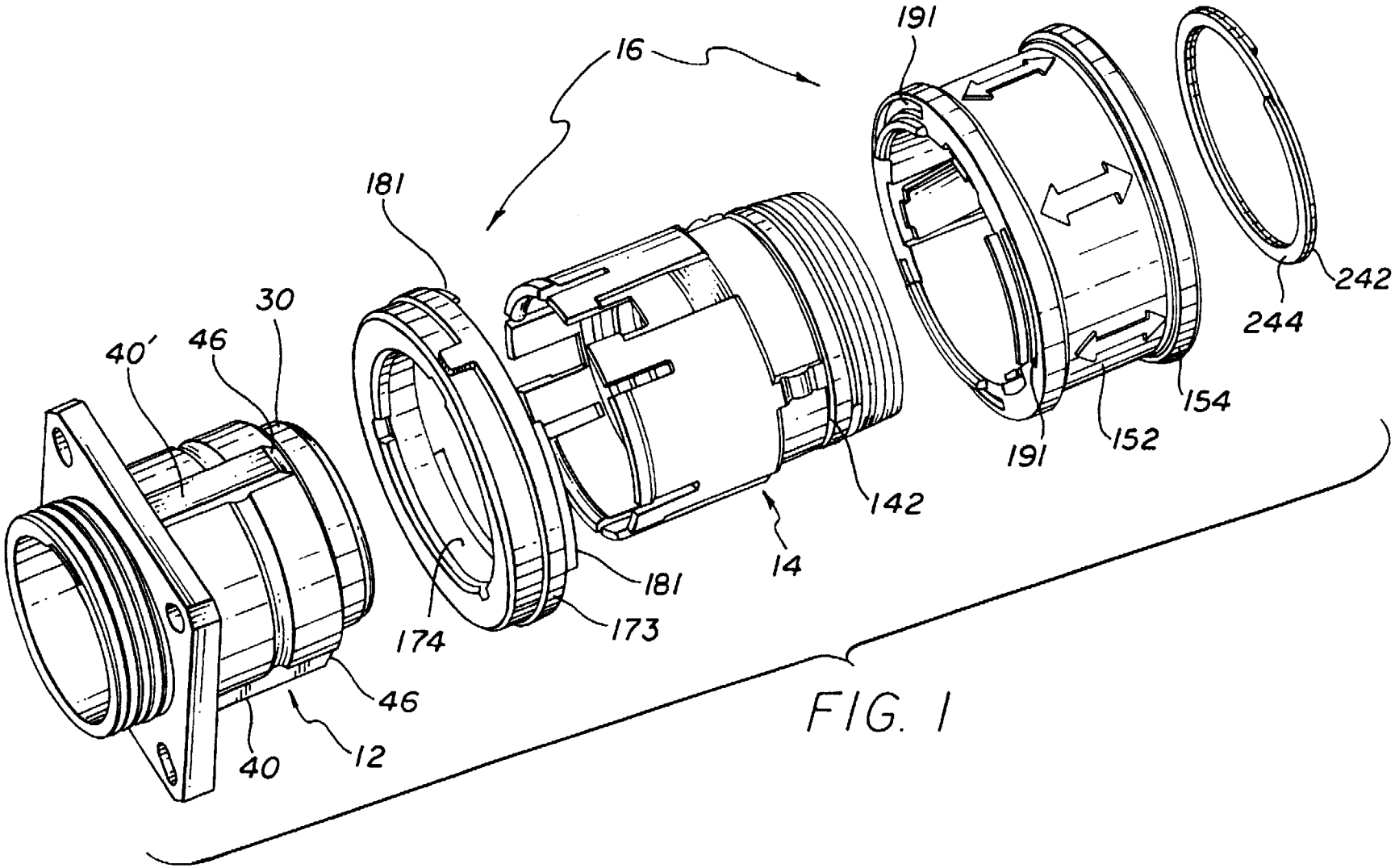
FIG. 1 is an exploded perspective view of a connector of the present invention showing a plug housing, a collar and a receptacle housing.

Referring now the drawings, and in particular to FIG. 1 a preferred electrical connector, indicated generally by the reference numeral 10, is shown. The connector is comprised of a receptacle housing 12, a plug housing 14, and a collar 16. The receptacle housing and the plug housing are preferably configured to be detachably coupled to each other telescopically. The collar 16 is preferably slidably mounted on the plug housing. The receptacle housing 12 houses a pin assembly 18, and the plug housing houses a socket assembly 20 (see FIGS. 6 and 7). The pin and socket assemblies 18 and 20 are exemplary of any of a pair of corresponding structures which can be co-joined to provide electrical transmission.

Coupling of the receptacle and plug housings, described in greater detail below, is accomplished by grasping the collar 16 and holding it so that the plug housing 14, to which the collar is slidably attached, is aligned with the receptacle housing 12. The collar is then pushed forward toward the receptacle housing 12, engaging the plug housing 14 and the receptacle housing 12 to each other, and moving the collar to a forward locking position. Uncoupling is accomplished by grasping the collar and pulling it back, away from the receptacle housing, which moves the collar rearward, out of its locking position, and which pulls the plug housing from coupled engagement with the receptacle housing. Thus, coupling and uncoupling of the two housings can be performed by a simple, one-hand push/pull operation.

Figure 2:
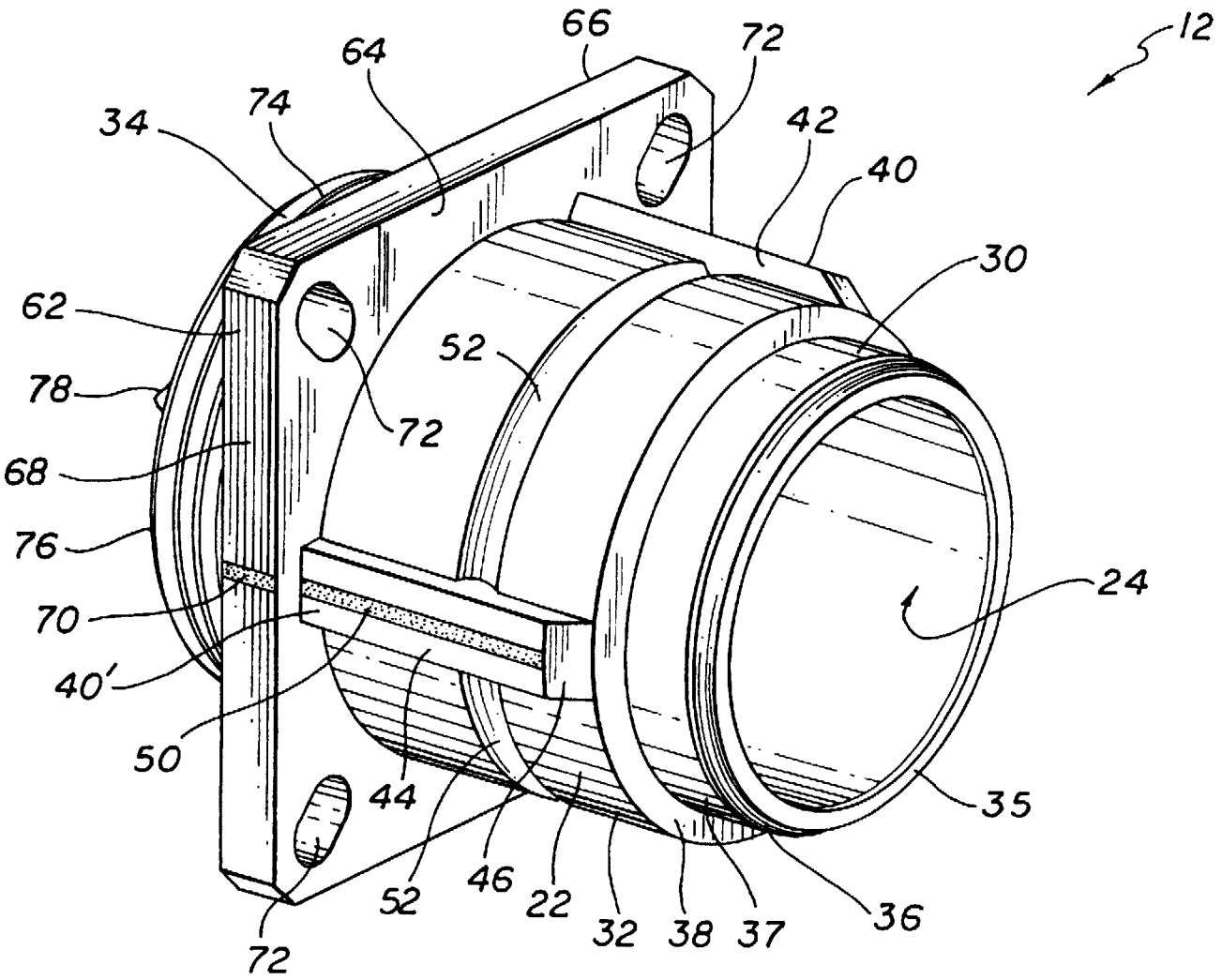
FIG. 2 is a perspective view of the receptacle housing of the connector of FIG. 1.

The receptacle housing 12 (FIG. 2) has a portion that is a generally tubular wall 22 defining an inside surface 24. The pin assembly 18 is housed within the receptacle housing. The exterior of the tubular wall 22 of the receptacle housing 12 has three major sections, a forward nose portion 30, a mid-portion 32, and a rear portion 34. The nose portion 30 has a smaller outside circumference than the mid-portion 32, and in coupling it enters the plug housing 14. The forward edge of the nose portion has a front surface 35, a nose chamfer 36 and an outside surface 37.

An annular chamfer ridge 38 separates the nose portion 30 and the mid-portion 32 of the tubular wall 22. Axially extending cams 40 are situated on the mid-portion 32 of the receptacle housing, at points around the circumference of the tubular wall 22. Each cam 40 is preferably of a generally rectangular shape, and each protrudes from the exterior surface of the mid-portion 32 of the tubular wall. Each cam 40 has vertical sides 42 and an outer surface 44. Each cam further has a ramp surface 46 at its forward end, extending from the exterior surface of the mid-portion at or near the chamfer ridge 38, upward and rearward to the outer surface 44 of the cam 40. One cam 40' may be enlarged and sized to cover a larger portion of the circumference of the tubular wall 22 of the plug housing than the other cams 40 to define a particular point of circumferential registration. A visual indicator 50 may be placed on the outer surface of the enlarged cam 40'. The visual indicator 50 may be formed of an ink type substance and may be applied by use of a video jet.

A groove 52 extends in a substantially circumferential orientation, with respect to the tubular wall 22, around the mid-portion 32 of the receptacle housing, between the cams 40. The groove itself is preferably substantially semi-circular in its cross-section.

The receptacle housing 12 has a mounting plate 62 oriented substantially along a plane perpendicular to the axis of the tubular wall 22, between the mid-portion and the rear portion thereof. The mounting plate has a forward face 64 facing the mid-portion, a rearward face 66 facing the rear portion of the plug housing, and a side surface 68 extending between the two faces. A visual indicator 70 may be applied in a similar manner as the visual indicator 50 to the side surface 68, in registration with the visual indicator 50 on the enlarged cam 40'. The plate further has holes 72 extending from forward face 64 to the rearward face 66 to permit the plug housing to be mounted with bolts or screws to a wall or panel of an electrical device.

The rear portion 34 of the tubular wall 22 of the receptacle housing has a threaded surface 74. The threaded surface allows the receptacle housing to be connected, through threaded engagement, with a conduit or another component. Extending between the rear portion 34 of the exterior of the tubular wall 22 and the inside surface of the tubular wall, there is an annular end surface 76. Saw teeth 78 are arranged on the end surface for frictional engagement with such a connected component.

Figure 3:
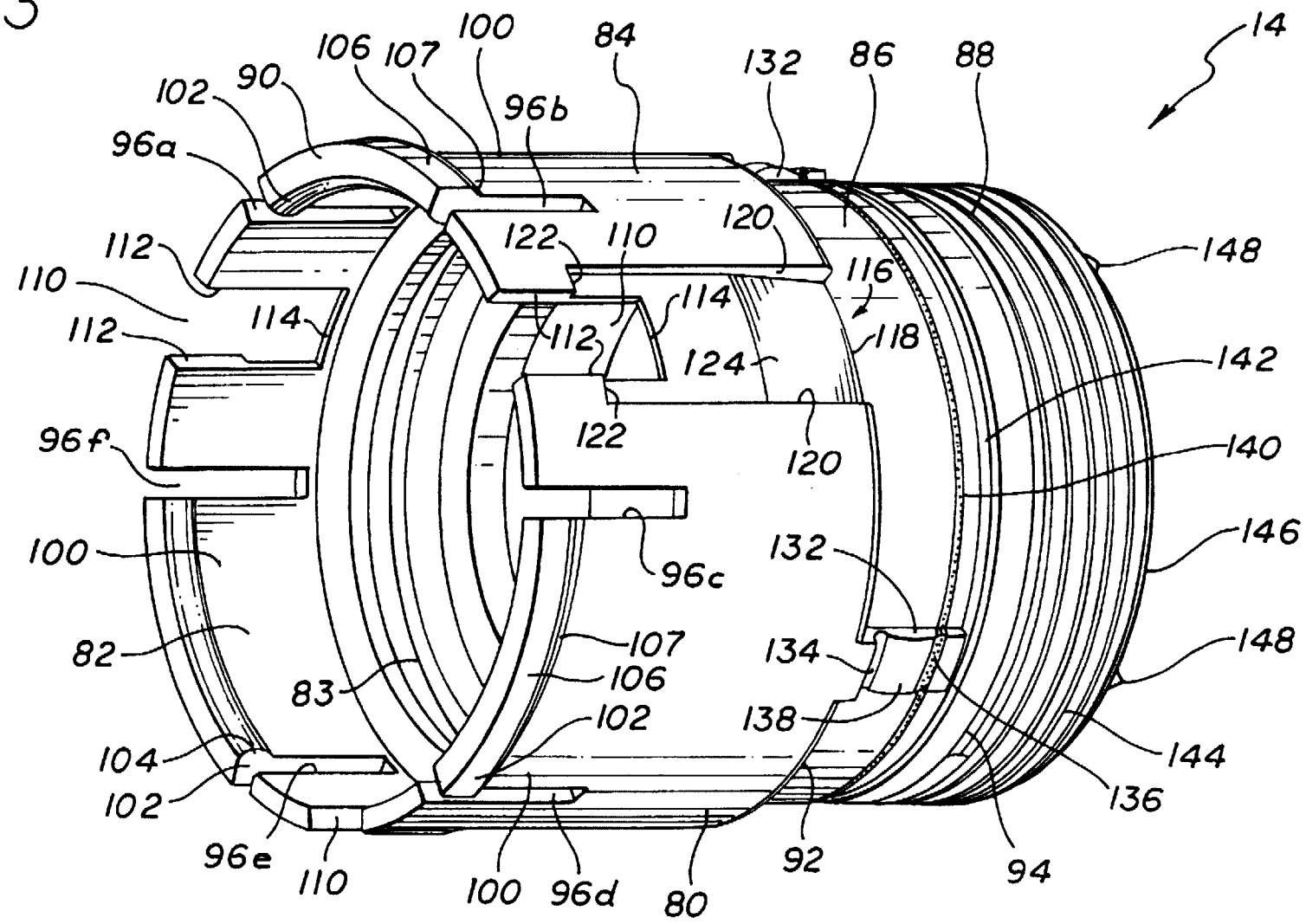
FIG. 3 is a perspective view of the plug housing of the connector of FIG. 1.

Referring now to FIG. 3, the plug housing 14 also has a generally tubular wall 80 defining an interior surface 82, within which the socket 20 (see FIG. 6) is housed. The interior surface may have internal shoulders 83 to assist in anchoring the socket 20. The interior surface 82 may further have an interior groove 85 which can retain an O-ring 87 (see FIGS. 6 and 7). The exterior of the tubular wall 80 of the plug housing has three sections: a forward section 84, a mid-section 86, and a rear section 88. An annular front face 90 extends between the forward section 84 and the interior surface 82 of the tubular wall. The forward section 84 extends from the annular front face 90, rearward, to a circumferential ridge 92 which separates the forward section 84 from the mid-section 86 of the tubular wall of the socket housing. A second circumferential ridge 94 of a similar orientation separates the mid-section 86 from the rear section of the tubular wall of the socket housing 88.

The forward section 84 of the plug housing has slits **96*a*, 96*b*, 96*c*, 96*d*, 96*e*, and 96*f* which extend through the tubular wall 80 to the interior surface 82. The slits 96*a–f* each extend, axially with respect to the tubular wall 80, from the annular front face. Slit pairs 96*a* and 96*b*, 96*c* and 96*d*, and 96*e* and 96*f*, define resilient fingers 100 in tubular wall 80 of the plug housing, which are free at the annular face 90 of the tubular wall. The slits 96 permit the resilient fingers 100 to be splayed outward or bent inward, with respect to the tubular wall of the plug housing, in response to a force in such respective direction. Heads 102 are formed at the free ends of the fingers. Each head 102 has an inner head 104 which projects into the interior of the tubular wall 80 of the plug housing and an outer head 106 which protrudes from the exterior surface of the forward section 84 of the plug housing. The fingers 100 preferably have chamfers 107 immediately rearward of each outer head 106**.

In addition to the slits 96*a*–96*f*, the forward section 84 of the tubular wall 80 of the plug housing has open slots 110, extending rearward from the front face of the plug housing, each defined by slot side surfaces 112 and a slot end surface 114. The slot side surfaces 112 and the slot end surfaces 114 extend from the exterior surface of the tubular wall 80 to the interior surface 82 of the tubular wall of the plug housing. The tubular wall 80 of the plug housing 14 has at least one slot for each cam 40 on the receptacle housing. The slots 110 are arranged around the circumference of the tubular wall 80 of the plug housing 14 in correspondence with the circumferential placement of cams 40 on the receptacle housing. Thus, when the plug housing 14 is held in substantial axial alignment with the receptacle housing 12, registration between the slots 110 of the plug housing and the cams 40 of the receptacle housing can be achieved.

The forward section 84 of the plug housing tubular wall 80 has notches 116 at the rear of the forward section 84 of the tubular wall. The notches 116 each define an opening 118 where the circumferential ridge 92 separates the forward portion 84 and the mid-portion 86 of the plug housing, and each notch extends forward, from the circumferential ridge 92, toward, but spaced from, the annular front face 90 of the plug housing. Each notch has two side walls 120 which extend axially with respect to the tubular wall 80 of the plug housing, and a stop wall 122, which extends circumferentially with respect to the tubular wall 80 of the plug housing. Each notch has a floor surface 124. Each notch floor surface 124 is divided by a notch ridge 126 which extends between the two side walls 120 substantially parallel to the stop wall 122. From the notch opening 118, where the notch floor 124 meets the exterior surface of the mid-section 86 of the tubular wall 80, the notch floor surface is inclined radially outward with respect to the tubular wall of the socket housing. Between the notch ridge 126 and the notch stop wall 122, the notch floor is not inclined, but substantially of the same radius with respect to the axis of the tubular wall.

The notches 116 are arranged around the circumference of the tubular wall 80, in axial registration with respective slots 110. The notches 116 straddle each open slot circumferentially, and each slot 110 extends into its corresponding notch, through the stop wall 122, with each end surface 114 of each slot 116 being rearward of each stop wall 122 of the corresponding notch 116.

The mid-section 86 of the tubular wall 80 of the plug housing has axially extending pedestals 132 arranged around the circumference of the plug housing 14, abutting the circumferential ridge 92. Each pedestal has a forward groove 134, close to the circumferential ridge 92; a rearward groove 136, spaced away from the circumferential ridge 92; and an intervening ridge 138 separating the forward and rearward grooves 134 and 136. The grooves 134 are directed circumferentially.

The plug housing further may include a visual indicator 140, which extends circumferentially around the mid-section 86 of the tubular wall 80 through each of the rearward grooves 136. The visual indicator 140 may be formed of an ink type of substance and may be applied with a video jet. Rearward of the circumferential visual indicator, a channel 142 extends substantially circumferentially around the tubular wall 80 of the socket housing for receiving a flat retaining spring 242.

The rear section 88 of the tubular wall 80 of the plug housing has a threaded surface 144 for connection with another component or a conduit. An annular rear face 146 extends between the inside surface and the rear section of the tubular wall 80. Saw teeth 148 are arranged on the annular rear face 146 for frictional engagement with another such connected component.

Figure 4:
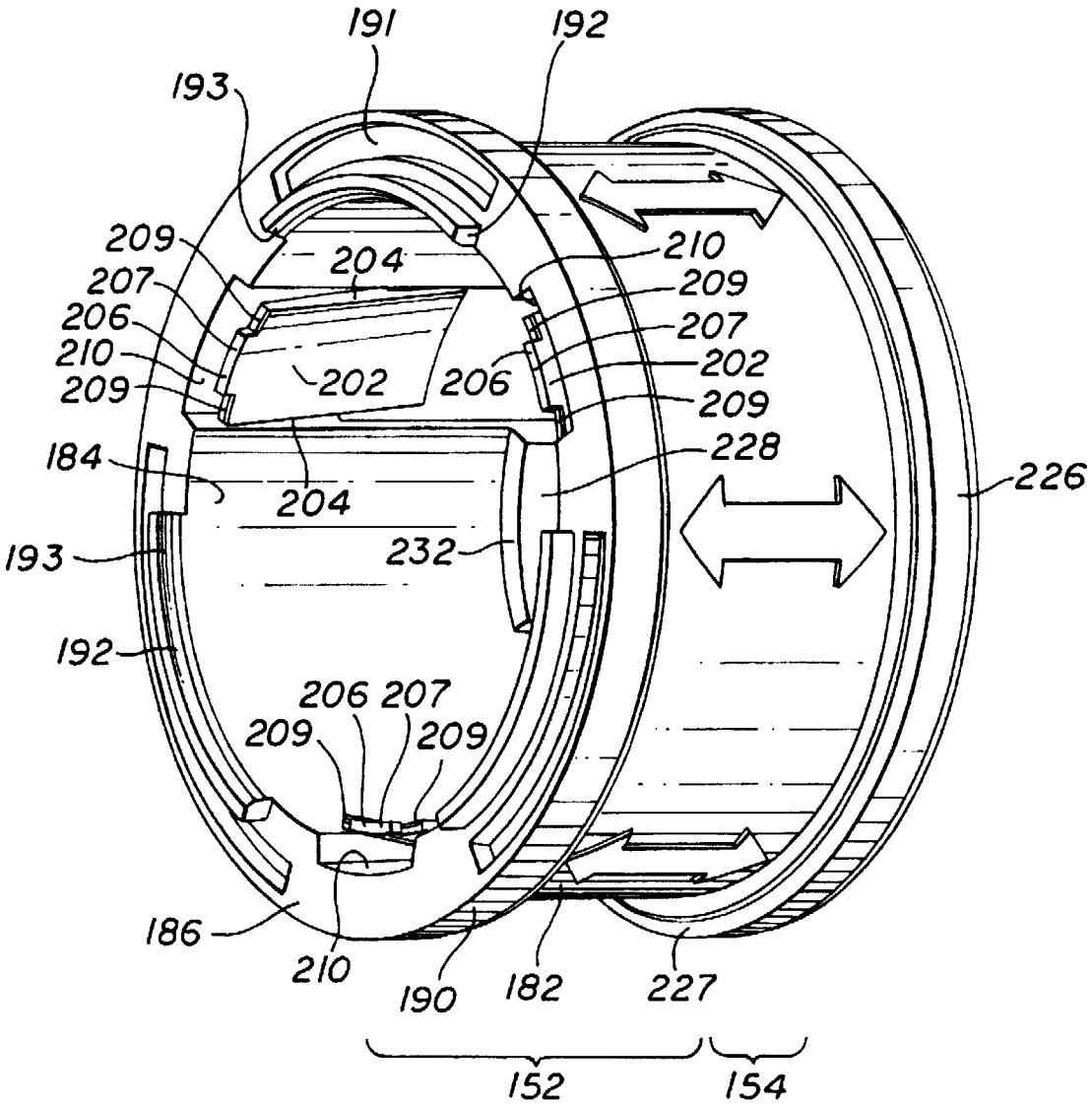
FIG. 4 is a perspective view of a portion of the collar of the connector of FIG. 1.
Figure 5:
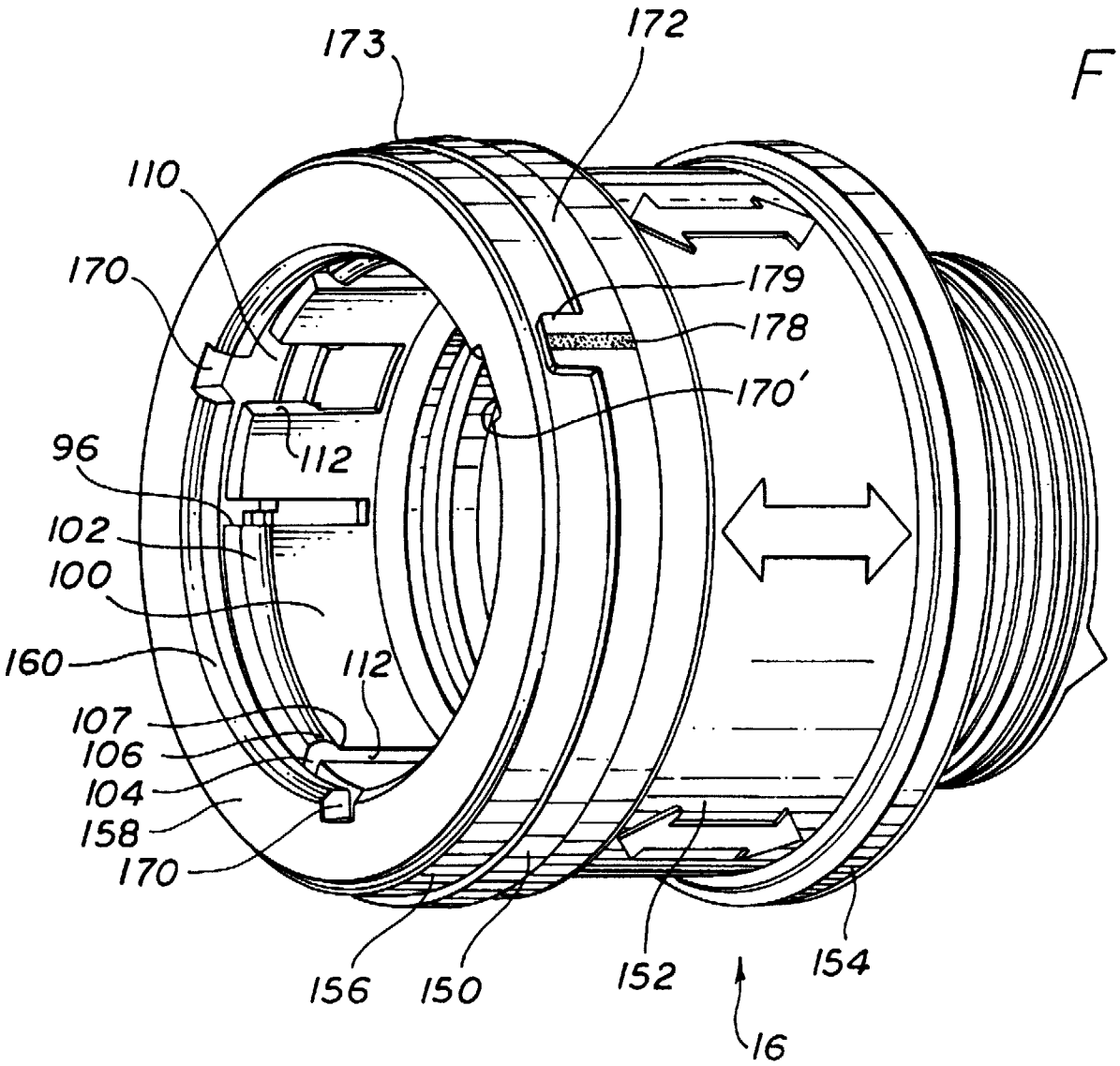
FIG. 5 is a perspective view of the plug housing and the collar of the connector of FIG. 1 showing the collar assembled onto the plug housing.

Referring now to FIGS. 4 and 5, the collar 16 has three major components, a collar nose 150, a collar body 152, and a collar tail 154. The collar nose 150 is generally annular in shape, and has tube portion 156 and face portion 158. The face portion 158 defines an annular opening 160. The face portion 158 has collar slots 170 extending axially therethrough with respect to the tube portion 156. There is at least one collar slot 170 for each cam 40 of the receptacle housing 12. One of the collar slots 170' is enlarged, and this enlarged collar slot 170' covers a greater circumferential portion of the collar nose than the other collar slots 170. The collar slots 170 are arranged circumferentially with respect to the annular opening 160 of the face portion in correspondence with the circumferential orientation of the cams 40 on the tubular wall 22 of the receptacle housing 12.

Figure 8:
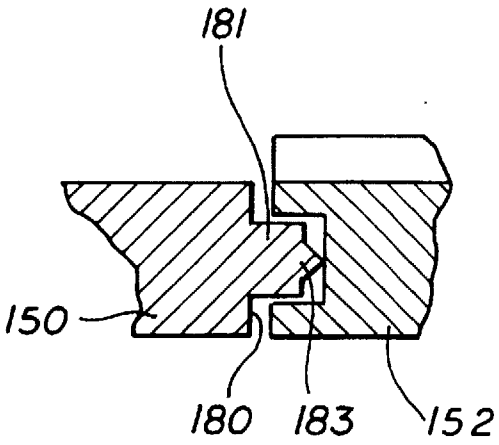
FIG. 8 is a cross-sectional detail of the connector as shown in FIGS. 6 and 7 showing the connection of the collar nose and collar body prior to sonic welding of the two.

The tube portion 156 of the collar nose 150 has an exterior surface 172, an interior surface 174 (see FIGS. 1 and 5). The exterior surface 172 may include an axial visual indicator 178, in circumferential registration with the enlarged collar slot 170', which may be made of an ink type substance and which may be applied with a video jet. The exterior surface 172 may further include an embossment 179, also in circumferential registration with the enlarged collar slot 170, for further visual indication of circumferential orientation of the collar. The tube portion has a rear annular face 180 (see FIGS. 6–8). The tube portion may be enlarged in the region adjacent to the rear annular face 180 to form a flange 173. The rear annular face 180 may have projections 181, which in turn may have energy director tappers 183 for sonic welding of the collar nose 150 to the collar body 152.

The collar body 152 (see FIG. 4) is generally tubular in shape, and has an exterior surface 182, an interior surface 184, and an annular front face 186. The collar body may be enlarged in the region adjacent to the annular front face 186 to form a flange 190. The annular front face 186 may have projections 192 (see FIG. 4). The projections 192 may further have inclines 193. The annular front face 186 may further have indents 191.

The interior surface 184 of the collar body 152 has tabs 202, each defined by two side edges 204 and a forward edge 206. Each forward edge 206 preferably has a tab protrusion 207 abutted on either side by tab shoulders 209. The tabs are unattached to the interior surface 184 of the collar body at their respective forward edges 206, and the forward edges 206 of each of the tabs face the same direction as the front face 186 of the collar body 152. Each of the tabs 202 is resiliently attached to the interior surface 184 of the collar body 152, and may be formed integral with the inclined interior surface 200 of the collar body. Each of the tabs is biased to extend radially inward from the interior surface 184 of the collar body 152, and together the forward edges 206 of the tabs extend radially inward to form a circumference smaller than that of the interior surface 184 of the collar body 152. The interior surface 184 of the collar body has collar niches 210 corresponding to and framing each of the tabs 202.

Figure 6:
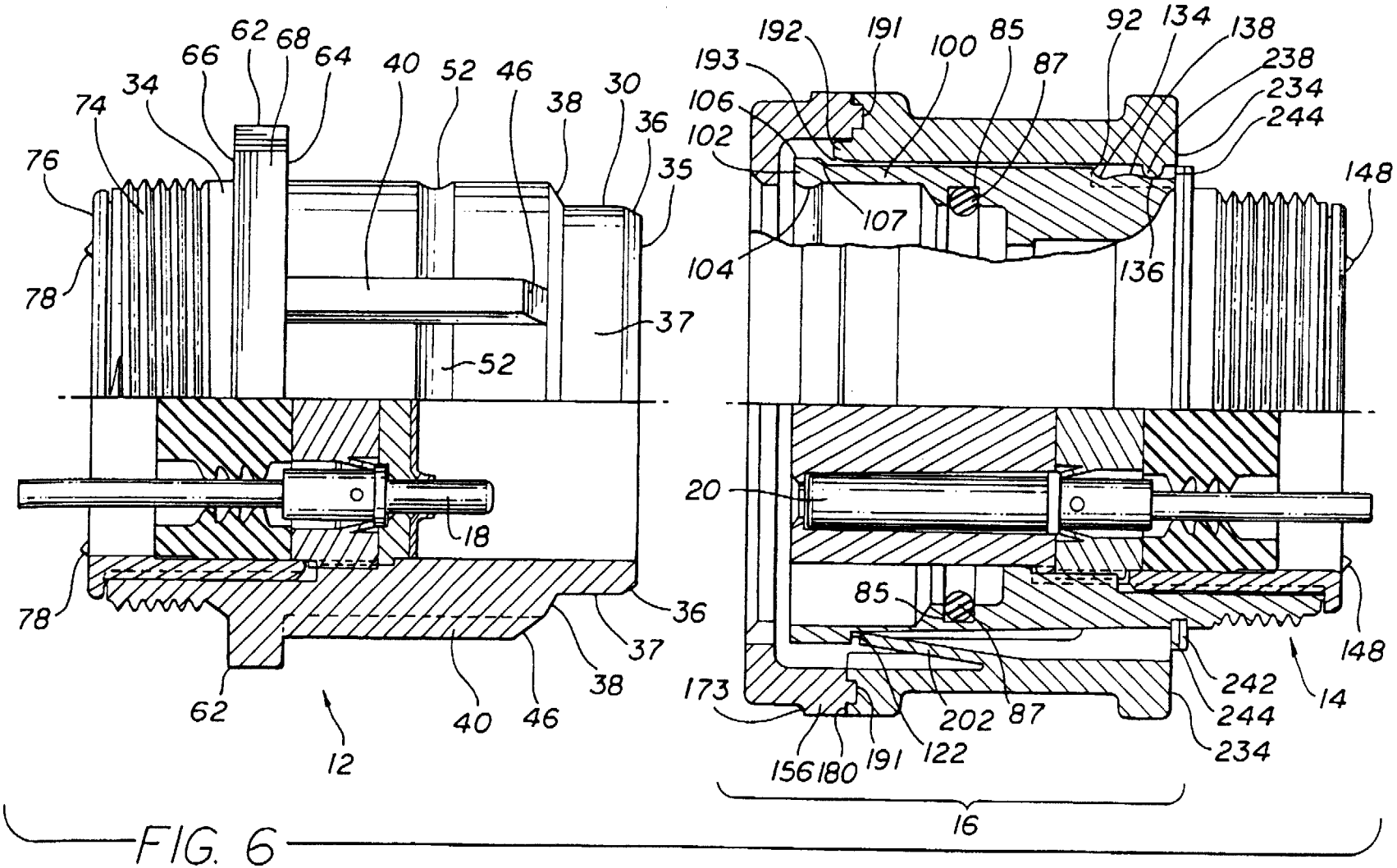
FIG. 6 is a side partial cross-sectional view of the connector of FIG. 1 with the collar assembled upon the plug housing prior to coupling of the plug and receptacle housings.

The collar tail 154 is joined to the collar body and is itself generally annular in shape, having an exterior surface 226 and an interior surface 228 (see FIGS. 4 and 6). The outer diameter of the collar tail is greater than that of the collar body and defines an exterior shoulder 227. The inner diameter of the collar tail is less than that of the collar body and defines an interior shoulder 232. The collar tail has an annular rear face 234 extending between the exterior surface 226 of the collar tail 154 to the interior surface 228 of the collar tail 154. Channels 236 extend axially through the interior surface of the collar tail. Within each of the channels 236 is a preferably integral sill 238.

With reference again to FIG. 1, the collar 16 is mounted on the plug housing 16 prior to coupling of the plug housing and the receptacle housing 12. The collar body 152 and the collar tail 154, which may be joined to each other, are positioned so that the front face 186 of the collar body faces the annular rear face 146 of the plug housing 14, with the tabs 202 on the interior surface 184 the collar body 152 in registration with the notches 116 on the exterior surface of the plug housing. The collar body 152, with the attached collar tail 154, is then slid over the plug housing 14 toward the annular front face 90 of the plug housing. As the collar body and the attached collar tail are so slid over the plug housing, tabs 202 on the inside surface enter the notches 116 on the exterior surface of the plug housing, and the forward edges 206 of the tabs 202 contact the stop walls 122 of the notches 116. More specifically, the tab shoulders 209 rest against the stop walls 122, while the tab protrusions 207 extend into the respective open slots 110 of the plug housing 14. In this position, the sills 238 of the collar are engaged with the rearward grooves 136 of the pedestals 132 on the plug housing (see FIG. 6).

Figure 7:
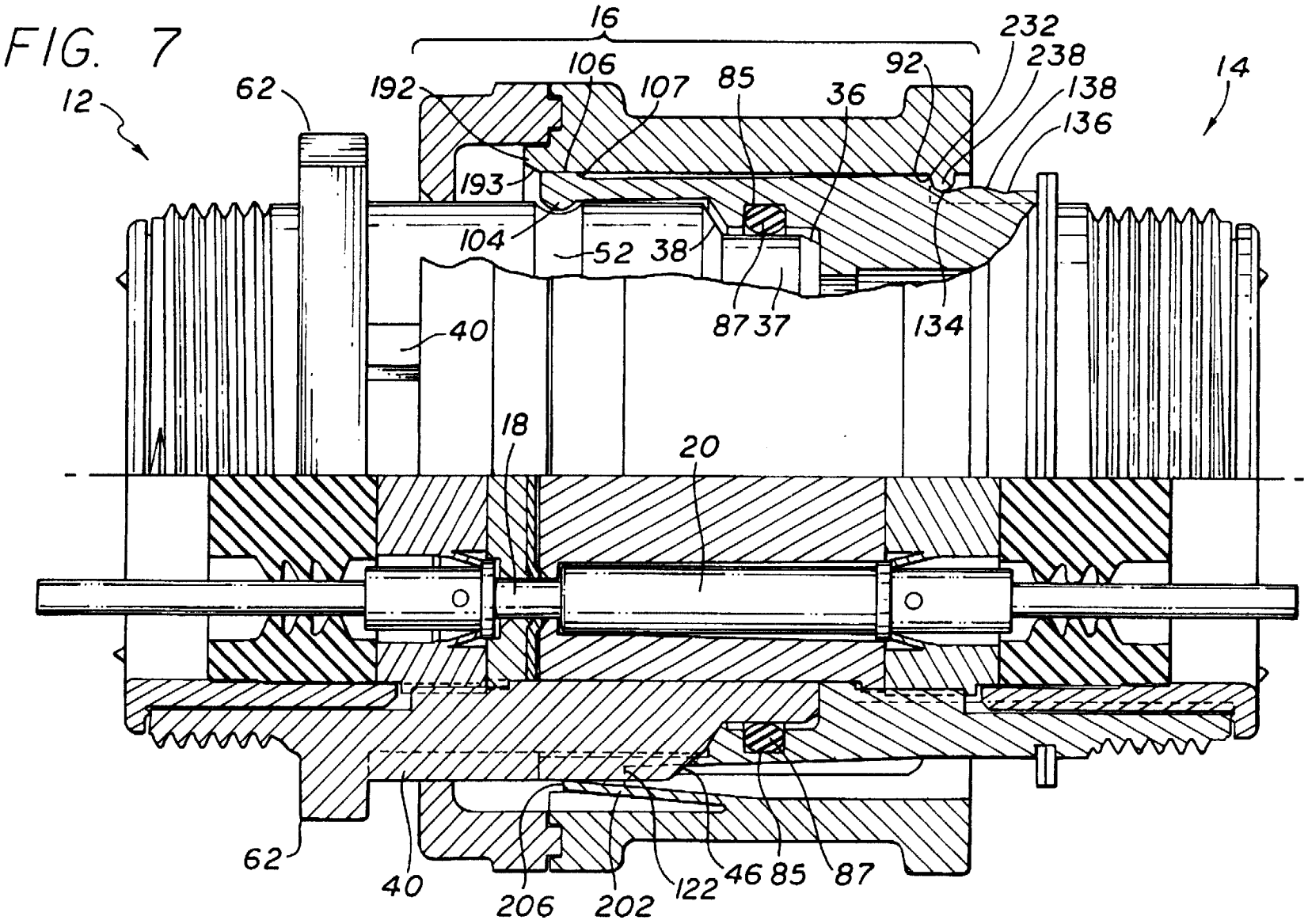
FIG. 7 is a side cross-sectional view of the connector of FIG.1 with coupling of the housings completed.

With the collar body and the attached collar tail in place, the collar nose 150 (as yet unattached) is positioned so that the annular front face 90 of the plug housing faces the interior surface 174 of the collar-nose 150 (see FIG. 1). The collar nose is further positioned so that the projections 181 on the rear annular face 180 of the tube portion of the collar nose 150 are put into registration with the indents 191 on the annular front face 186 of the collar body 152. The collar nose is then slid rearward with respect to the plug housing, over the plug housing. The collar nose 150 is pushed into full engagement with the collar body 152 so that the rear annular face 180 of the collar nose 150 abuts the annular front face 186 of the collar body 152. At the same time, projections 181 fit within the indents 191 of the collar body 152. (See FIG. 8.) Sonic welding may be applied to permanently secure the engagement of the collar nose 150 and the collar body 152 and the sonic welding may be facilitated by energy director tapers 183. FIGS. 6 and 7 show the collar nose and collar body as sonically welded together.

With the collar 16 fully assembled around the plug housing, the flat retaining spring 242 (FIG. 1), having a retaining surface 244, is inserted into the channel 142 on the mid-portion of the plug housing 14. Once inserted into the channel, the retaining surface 244 of the retaining spring 242 contacts the rear annular face 234 of the collar tail 154 (see FIGS. 6 and 7). This contact prevents the collar from moving rearward with respect to the plug housing. At the same time, the collar is prevented from forward movement with respect to the plug housing by the contact of the forward edges 206 of the collar tabs 202 against the stop walls 122 of the plug housing notches 116. Thus, while the collar 16 is in slidable engagement around the plug housing, it is prevented from slidable movement with respect to the plug housing in this manner. The collar can only be moved with respect to the plug housing when coupling of the plug housing and the receptacle housing is carried out, as explained in further detail below.

To couple the plug housing and the receptacle housing, the two housings are positioned with respect to each other in substantial axial alignment such that the nose portion 30 of the receptacle housing 12 faces the exterior surface 162 of the front face portion 158 of the collar nose 150 of the collar 16, which has been assembled over the plug housing. (See FIGS. 1, 6 and 7.) The receptacle housing and plug housing, with the attached collar 16, are put into circumferential alignment such that the cams 40 of the receptacle housing 12 are in registration with the collar slots 170. More particularly, the enlarged cam 40' and the enlarged collar slot 170' are put into registration with each other. In this orientation, the visual indicators 50 and 70 on the receptacle housing and the visual indicator 178 on the collar 16 are all in alignment. Because the collar slots 170 were previously aligned with the plug housing slots 110 when the collar was assembled on the plug housing, this orientation of the receptacle housing 12 and the collar 16 puts the cams 40 of the receptacle housing into registration with the slots 110 of the plug housing.

The receptacle housing and the plug housing, with the attached collar, are pushed together telescopically, such that the tubular wall 22 of the receptacle housing 12 enters the tubular wall 80 of the plug housing 14. The cams 40 of the receptacle housing enter the collar slots 170 and then enter the slots 110 of the plug housing. The plug housing is pushed against the receptacle housing by the collar; because the collar is prevented from forward movement with respect to the plug housing by contact of the tab shoulders 209 of the collar tabs 202 against the stop walls 122 of the plug housing notches 116, the plug housing moves with the collar as the collar is pushed against the receptacle housing.

As the tubular wall 22 of the receptacle housing is pushed into the tubular wall 80 of the plug housing, the inner heads 104 of the plug housing resilient fingers 100 are first contacted by the chamfer ridge 38 of the plug housing. Further pushing of the receptacle housing into the plug housing causes the fingers 100 to be splayed outward, so that the inner heads 104 of the fingers 100 ride up onto the exterior surface of the receptacle housing. As the receptacle housing and the plug housing are pushed into further engagement with each other, the inner heads 104 of the fingers 100 of the plug housing are pushed toward the groove 52 on the receptacle housing. When the receptacle housing and the plug housing are in full engagement with each other, the inner heads 104 are aligned with the groove 52, whereupon the resiliency of the plug housing fingers 100 pulls the inner heads 104 into the grooves of the receptacle housing. In this position, the fingers 100 of the plug housing are no longer splayed, and the resiliency of the fingers 100 holds the inner heads 104 within the groove 52.

As the slots 110 of the plug housing receive the cams 40 of the receptacle housing, during the telescopic joining of the two housings, the ramp surfaces 46 of the cams 40 contact the forward edges 206 of the tabs 202. More specifically, the ramp surfaces contact the tab protrusions 209 of the respective tabs. As the receptacle housing and plug housing are pushed into further telescoped engagement with each other, the ramp surfaces 46 push the tabs 202 into the niches 210 of the interior surface of the collar body 152, disengaging the contact of the tab shoulders 209 against the stop walls 122 of the plug housing notches 116. As the inner heads 104 of the plug housing fingers reach and are received into the groove 52 of the receptacle housing, the ramp surfaces 46 have pushed the tabs 202 sufficiently into the collar niches 210 to completely remove contact of the tabs 202 against the stop walls 122 of the plug housing notches. With this contact removed, the collar is no longer prevented from movement forward with respect to the plug housing. Continued forward pushing of the collar 16 thus now moves the collar forward with respect to the plug housing. As the inner heads 104 of the plug housing fingers 100 are received into the groove 52, the collar is moved forward. As the collar is moved forward on the plug housing, the inclines 193 on the collar body projections 192 slide against the chamfers 107 on the fingers 100 of the plug housing. This aids the collar to pass over the outer heads 106 of the plug housing fingers 100 with the collar over the outer heads of the plug housing fingers, the collar exerts radially inward pressure on the outer heads. This pressure of the collar against the finger heads 106 slightly compresses the fingers, and pushes the inner heads 104 of the housing fingers into deeper engagement with the groove 52 of the receptacle housing, thus preventing disengagement of the receptacle and plug housings.

As the collar 16 is moved forward to cover the outer heads of plug housing fingers, the sills 238 of the collar tail are moved from engagement with the rearward pedestal grooves 136 of the plug housing to the forward pedestal grooves 134 of the plug housing. The movement of the sills 238 from the rearward pedestal grooves 136 to the forward pedestal grooves 134 provides a tactile and an audible indication of such movement, as the sills pass over the intervening ridges 138 and fall into the forward pedestal grooves 134. The removal of the sills 238 from the rearward grooves 136, and the movement forward of the collar with respect to the plug housing, exposes the circumferential visual indicator 140 on the plug housing, providing a visual signal that the collar is in its forward-most, locking position. In this position (see FIG. 7), the forward interior lip 232 of the collar tail of the collar contacts the circumferential ridge 92 that separates the forward section 84 of the plug housing from the mid-section 86 of the plug housing. This contact prevents further forward movement of the collar 16 with respect to the plug housing. Once so coupled, the O-ring 87 on the interior of the plug housing seals against the outside surface 37 of the nose portion of the receptacle housing.

In this manner, the receptacle housing and plug housing are fully coupled. The contact of the projections 192 of the collar body against the outer heads 106 of the plug housing fingers prevents the splaying out of the fingers which would occur if the inner heads were to be pulled from the groove 52. Thus the inner heads are held within the groove 52 by the presence of the collar in its forward-most position. The collar is prevented from inadvertent rearward movement by the engagement of its sills 238 within the forward grooves 134 of the plug housing pedestals 132.

Uncoupling is achieved by pulling the collar rearward, with sufficient force to dislodge the sills 238 from engagement with the forward grooves 134 of the pedestals and carry the sills over the intervening ridges 138, into engagement with the rearward grooves 136. In this position, the rear annular face 234 of the collar tail is once again in contact with the retaining surface 244 of the retaining spring 242, which is held by the plug housing channel 142. With this contact, the collar is prevented from further movement rearward with respect to the plug housing, and continued rearward pulling of the collar 16 pulls the plug housing along with it. With the collar moved to its rearward position, the contact between the projections 192 on the collar body 152 and the outer heads 106 of the plug housing fingers is removed. With the contact removed, the fingers 100 of the plug housing are no longer prevented from being splayed. Further rearward pulling of the collar pulls the plug housing rearward, and without the contact of the collar against the outer heads 106 of the plug housing fingers, the inner heads ride up the groove 52, splaying the fingers 100. Further pulling removes the inner heads from the groove 52, and the plug housing is pulled from engagement with the receptacle housing.

As the plug housing is so disengaged from the receptacle housing, the cams 40 of the plug housing retreat from the slots 110 of the plug housing. As the cams so retreat, the tabs 202 on the interior surface of the collar body 152 are released from contact with the cams. With the contact of the cams 40 removed from the tabs 202, the tabs move by their own resilience, radially inward, to their original position, where the forward edges 206 of the tabs 202 once again are in contact with the stop walls 122 of the respective plug housing notches 116. In this position, the collar 16 is again restrained from forward movement with respect to the plug housing, and the circumferential visual indicator 140 on the plug housing is covered by the collar, signaling the user that the collar is in its initial, unlocked position.

It should be appreciated from the foregoing description that the present invention provides a connector in which two housings are coupled and locked into coupled engagement by a locking collar, and in which the locking collar cannot be moved into its locking position until coupling is performed. Moreover, the present invention permits coupling and locking to be done in a single motion and unlocking and uncoupling to be likewise done in a single motion, permitting simple push and pull operation. The present invention further provides visual, audible and tactile indications to the user of whether the locking collar is in its locking position or in its unlocked position. These and other advantages demonstrate that the electrical connector of the present invention presents a definite advantage in all applications where such electrical connectors are used.

Although the invention has been described in detail with reference to the presently preferred embodiment, it should be understood by those with ordinary skill in the art that various modifications can be made without departing from the invention. Accordingly, the invention is defined only by the appended claims.

I claim:

1. A connector for joining two electrical connection assemblies, comprising:

a first assembly housing having a generally tubular wall open at one end and a cam;

a second assembly housing having a generally tubular wall open at one end;

a collar, slidably attached to the exterior of the tubular wall of the second assembly housing;

a movable tab on one of the second assembly housing and the collar, the tab in axial alignment with the cam of the first assembly housing; and a stop ridge on the other of the second assembly housing and the collar, the tab and the stop ridge aligned so that the tab contacts the stop ridge at a predetermined point, thus restricting axial movement of the collar relative to the second assembly housing;

wherein upon assembly of the first assembly housing and the second assembly housing, at a predetermined point of axial motion of the one with respect to the other, the cam of the first assembly housing pushes the movable tab, disengaging the tab from the stop ridge, so that the collar is no longer so restricted, by contact of the tab and the stop ridge, from axial movement relative to the second assembly housing and wherein the collar is permitted to move axially toward the first housing when the tab is disengaged from the stop ridge by the cam.

2. The connector of claim 1, further comprising, a groove on one of the first housing and second housing; and at least one finger on the other of said first housing and second housing, the finger having a head;

wherein upon coupling, the head of the finger of the one housing fits within the groove of the other housing so that axial movement of the two housings with respect to each other in an uncoupling direction is resisted by the fit of the head of the finger within the groove.

3. The connector of claim 2 further comprising a plurality of fingers each having a head fitting in the groove of the outer housing.

4. The connector of claim 3 further comprising:

a plurality of cams on the first assembly housing;

a plurality of movable tabs on one of the second assembly housing and the collar, the tabs in axial alignment with the cams of the first assembly housing; and a plurality of stop ridges on the other of the second assembly housing and the collar, -the tabs and the stop ridges aligned so that the tabs contact the stop ridges at a predetermined point, thus restricting axial movement of the collar relative to the second assembly housing;

wherein upon assembly of the first assembly housing and the second assembly housing, at a predetermined point of axial motion of the one with respect to the other, the cams of the first assembly housing push the movable tabs, disengaging the tabs from the stop ridges, so that the collar is no longer so restricted, by contact of the tabs and the stop ridges, from axial movement relative to the second assembly housing.

5. The connector of claim 2 wherein the collar is moveable between a first position and a second locking position such that the collar contacts the finger and holds the head of the finger within the groove in the second locking position.

6. The connector of claim 5 further comprising a head on the finger which extend radially outward from the generally tubular wall of the housing having the finger and further comprising a projection on the collar that contacts the radially outward extending head of the finger upon axial movement of the collar toward the open end of the second housing.

7. The connector of claim 6 further comprising an incline on the projection;

wherein the incline contacts the radially outward extending head of the finger upon axial movement of the collar toward the open end of the second housing.

8. The connector of claim 1, in which the cam has a ramp surface extending substantially from the coupling end of the tubular wall radially outward and rearward.

9. The connector of claim 1 further comprising:

a pair of at least partially circumferential grooves on the housing to which the collar is slidably attached; and a sill on the collar selectively interlocked with each of the pair of at least partially circumferential grooves on the housing to which the collar is slidably attached.

10. A connector for joining two electrical connection assemblies, comprising:

a first assembly housing having a generally tubular wall open at one end and a plurality of cams;

a second assembly housing having a generally tubular wall open at one end;

a collar, slidably attached to the exterior of the tubular wall of the second assembly housing;

a plurality of resiliently movable tabs on one of the second assembly housing and the collar, the tabs arranged in axial alignment with the cams of the first assembly housing; and a plurality of stop ridges on the other of the second assembly housing and the collar, the tabs and the stop ridges aligned so that the tabs contact the stop ridges at a predetermined point, thus restricting axial movement of the collar relative to the second assembly housing;

wherein upon assembly of the first assembly housing and the second assembly housing, at a predetermined point of axial motion of the one with respect to the other, the cams of the first assembly housing push the resiliently movable tabs, disengaging the tabs from the stop ridges, so that the collar is no longer so restricted, by contact of the tabs and the stop ridges, from axial movement relative to the second assembly housing; and wherein upon disassembly of the first assembly housing and the second assembly housing, at a predetermined point of axial motion of the one with respect to the other, the cams of the first assembly housing disengage from the tabs, permitting the tabs to return by their own resiliency substantially to their initial position engaging their respective stop ridges, so that the collar is once again restricted, by contact of the tabs and the stop ridges, from axial movement relative to the second assembly housing.

11. The connector of claim 10, further comprising, a groove on one of the first housing and second housing; and at least one finger on the other of said first housing and second housing, the finger having a head;

wherein upon coupling, the head of the finger of the one housing fits within the groove of the other housing so that axial movement of the two housings with respect to each other in an uncoupling direction is resisted by the fit of the head of the finger within the groove.

12. The connector of claim 11 further comprising a plurality of fingers each having a head fitting in the groove of the outer housing.

13. The connector of claim 12 further comprising heads on the fingers which extend radially outward from the generally tubular wall of the housing having the fingers.

14. The connector of claim 13 further comprising at least one projection;

wherein the projection contacts the radially outward extending head of one of the fingers upon axial movement of the collar toward the open end of the second housing.

15. The connector of claim 14 further comprising:

a pair of at least partially circumferential grooves on the housing to which the collar is slidably attached; and a sill on the collar selectively interlocked with each of the pair of at least partially circumferential grooves on the housing to which the collar is slidably attached.

16. A connector for joining two electrical connection assemblies, comprising:

a first assembly housing having a generally tubular wall open at one end and a cam;

a second assembly housing having a generally tubular wall open at one end;

a groove on one of the first assembly housing and the second assembly housing and at least one finger on the other of the first assembly housing and the second assembly housing, the finger having a head, wherein upon coupling, the head of the finger of the one housing fits within the groove of the other housing so that axial movement of the two housings with respect to each other in an uncoupling direction is resisted by the fit of the head of the finger within the groove;

a collar, slidably attached to the exterior of the tubular wall of the second assembly housing;

a movable tab on one of the second assembly housing and the collar, the tab in axial alignment with the cam of the first assembly housing; and a stop ridge on the other of the second assembly housing and the collar, the tab and the stop ridge aligned so that the tab contacts the stop ridge at a predetermined point, thus restricting axial movement of the collar relative to the second assembly housing;

wherein upon assembly of the first assembly housing and the second assembly housing, at a predetermined point of axial motion of the one with respect to the other, the cam of the first assembly housing pushes the movable tab, disengaging the tab from the stop ridge, so that the collar is no longer so restricted, by contact of the tab and the stop ridge, from axial movement relative to the second assembly housing.

17. A connector for joining two electrical connection assemblies, comprising:

a first assembly housing having a generally tubular wall open at one end and a cam;

a second assembly housing having a generally tubular wall open at one end;

a collar, slidably attached to the exterior of the tubular wall of the second assembly housing;

a pair of at least partially circumferential grooves on the housing to which the collar is slidably attached, and a sill on the collar selectively interlocked with each of the pair of at least partially circumferential grooves on the housing to which the collar is slidably attached.

a movable tab on one of the second assembly housing and the collar, the tab in axial alignment with the cam of the first assembly housing; and a stop ridge on the other of the second assembly housing and the collar, the tab and the stop ridge aligned so that the tab contacts the stop ridge at a predetermined point, thus restricting axial movement of the collar relative to the second assembly housing;

wherein upon assembly of the first assembly housing and the second assembly housing, at a predetermined point of axial motion of the one with respect to the other, the cam of the first assembly housing pushes the movable tab, disengaging the tab from the stop ridge, so that the collar is no longer so restricted, by contact of the tab and the stop ridge, from axial movement relative to the second assembly housing.

18. A connector for joining two electrical connection assemblies, comprising:

a first assembly housing having a generally tubular wall open at one end and a cam;

a second assembly housing having a generally tubular wall open at one end;

a collar, slidably attached to the exterior of the tubular wall of the second assembly housing;

a pin assembly housed within and engaging one of said first and second assembly housings;

a socket assembly housed within and engaging the other of said first and second assembly housings, wherein the pin assembly and the socket assembly may be joined to provide electrical transmission;

a movable tab on one of the second assembly housing and the collar, the tab in axial alignment with the cam of the first assembly housing; and a stop ridge on the other of the second assembly housing and the collar, the tab and the stop ridge aligned so that the tab contacts the stop ridge at a predetermined point, thus restricting axial movement of the collar relative to the second assembly housing;

wherein upon assembly of the first assembly housing and the second assembly housing, at a predetermined point of axial motion of the one with respect to the other, the cam of the first assembly housing pushes the movable tab, disengaging the tab from the stop ridge, so that the collar is no longer so restricted, by contact of the tab and the stop ridge, from axial movement relative to the second assembly housing.

19. The connector of claim 18 further comprising, a groove on one of the first assembly housing and the second assembly housing; and at least one finger on the other of said first assembly housing and the second assembly housing, the finger having a head;

wherein upon coupling, the head of the finger of the one housing fits within the groove of the other housing so that axial movement of the two housings with respect to each other in an uncoupling direction is resisted by the fit of the head of the finger within the groove.

20. The connector of claim 19 wherein the collar is moveable between a first position and a second locking position such that the collar contacts the finger and holds the head of the finger within the groove in the second locking position.

* * * * *